US006244581B1

(12) United States Patent
Arnhold

(10) Patent No.: US 6,244,581 B1
(45) Date of Patent: Jun. 12, 2001

(54) WEDGE CLAMP

(76) Inventor: William J. Arnhold, 2350 Maytown Rd., Bruceton, TN (US) 38317

( * ) Notice: Subject to any disclaimer, the term of this patent is extended or adjusted under 35 U.S.C. 154(b) by 0 days.

(21) Appl. No.: 09/499,131

(22) Filed: Feb. 7, 2000

(51) Int. Cl.[7] ..... B25B 1/10

(52) U.S. Cl. ..... 269/43; 269/152; 269/156; 269/88; 269/208; 269/217; 269/234

(58) Field of Search ..... 269/234, 217, 269/207, 208, 211, 88, 152, 156, 43

(56) References Cited

U.S. PATENT DOCUMENTS

| | | | | |
|---|---|---|---|---|
| 217,329 | | 7/1879 | Briggs et al. . | |
| 684,835 | | 10/1901 | Littell . | |
| 689,152 | | 12/1901 | Anderson . | |
| 827,874 | | 8/1906 | Lindberg . | |
| 871,390 | * | 11/1907 | Dietrichs | 269/234 |
| 1,619,989 | | 3/1927 | Rockwell . | |
| 2,359,677 | * | 10/1944 | Reeves | 269/234 |
| 4,290,371 | | 9/1981 | Snitzer et al. . | |
| 4,518,476 | * | 5/1985 | Delony et al. | 269/234 |
| 4,525,096 | | 6/1985 | Green et al. . | |
| 4,637,098 | | 1/1987 | Okura et al. . | |
| 4,742,657 | | 5/1988 | Veech . | |
| 4,844,646 | | 7/1989 | Wier . | |
| 4,906,127 | | 3/1990 | Nixon et al. . | |
| 5,730,432 | | 3/1998 | Gendreau et al. . | |
| 5,803,426 | | 9/1998 | Hart . | |
| 5,860,758 | | 1/1999 | Kozyrski et al. . | |
| 5,888,015 | | 3/1999 | Brown et al. . | |

* cited by examiner

*Primary Examiner*—Robert C. Watson
(74) *Attorney, Agent, or Firm*—Pitts & Brittian, P.C.

(57) ABSTRACT

A wedge clamp for clamping a plurality of planar members in a side-by-side disposition for work such as gluing to be performed thereon. The wedge clamp includes a rail unit which defines a track having two opposing side walls and an end wall disposed in a U-shaped configuration to closely receive the ends of stock members. The side walls are spaced apart to define a throat for closely receiving a selected thickness of stock. A base member is provided at one end of the rail unit, a second end of the base member extending away from side walls a distance at least as great as the width of the throat. The side walls and the end wall define a series of slotted openings for receiving a wedge block. At least one spacer is used to reduce the width of the throat and accommodate close receipt of the stock material defining a thickness less than that of the throat. The spacer defines an L-shaped cross section, with the first leg defining a first thickness and the second leg defining a second thickness. A retainer block is provided for assisting in using the rail unit to clamp workpieces along the length thereof The retainer block is dimensioned to be closely received within the track of the rail unit in a lengthwise direction A first notch is defined at a first end thereof for closely receiving stock material defining a first thickness, while a second notch is defined at a second end thereof for closely receiving stock material of a second thickness. An end cap is provided for closely receiving the end of each stock member in the latter disposition.

21 Claims, 10 Drawing Sheets

WEDGE CLAMP

TECHNICAL FIELD

This invention relates to the field of clamping devices. More specifically, the present invention is related to a device for clamping multiple pieces of wood or other materials in a side by side orientation.

BACKGROUND ART

In the field of woodworking, it is well known that it is often necessary to clamp multiple pieces of wood together in a side by side disposition This is especially true when forming a large planar member such as used in shelving, table tops, and the like. There are many types of clamping devices available for accomplishing such a task. Typically, the boards are disposed in a desired arrangement, an adhesive is applied on the contacting surfaces and the boards are pressed together. A clamp is then placed such that the boards are received within the throat of the clamp. The boards are then adjusted to ensure that they are in alignment to define a continuous top and bottom surface. Once the boards are manipulated into alignment, the clamp is tightened to bring the boards into close engagement with each other. The clamp is left in place until the adhesive is sufficiently cured.

This form of clamping is typically accomplished using a pipe claw or the like. In many conventional clamps, an elongated member such as a pipe is provided with one portion of a clamp being carried by one end thereof A second clamp portion is slidably engaged with the elongated member for crude adjustment of the throat width between the two portions. Once the boards have been properly aligned and the clamp is properly positioned over the boards, the clamp is then tightened, usually by manipulating the first clamp portion. However, it is well known that manipulating more than one board to ensure proper alignment between the two while also manipulating the clamp with respect to the boards can be cumbersome. Accordingly, it is often preferable to perform this function with only two boards at a time. In so doing, it is required to repeat this process several times in order to form large composite boards.

Other types of clamps have been produced for clamping various objects together. Typical of the art are those devices disclosed in the following U.S. patents:

| U.S. Pat. No. | Inventor(s) | Issue Date |
|---|---|---|
| 217,329 | R. H. Briggs et al. | July 8, 1879 |
| 684,835 | C. E. Lettell | Oct. 22, 1901 |
| 689,152 | L. E. Anderson | Dec. 17, 1901 |
| 827,874 | O. F. Lindberg | Aug. 7, 1906 |
| 1,619,989 | B. C. Rockwell | March 8, 1927 |
| 4,525,096 | J. L. Green et al | June 25, 1985 |
| 4,637,098 | M. Okura et al. | Jan. 20, 1987 |
| 4,742,657 | R. D. Veech | May 10, 1988 |
| 4,844,646 | J. H. Wier | July 4, 1989 |
| 4,906,127 | F. H. Nixon et al. | March 6, 1990 |
| 5,730,432 | B. Gendreau et al. | March 24, 1998 |
| 5,803,426 | J. F. Hart | Sept. 8, 1998 |
| 5,860,758 | V. T. Kozyrski et al. | Jan. 19, 1999 |
| 5,888,015 | K. H. Brown et al. | March 30, 1999 |

Of these devices, that disclosed by Briggs et al. ('329) is a clamping device in which a wedge shaped object is used to secure the internal components of a machining tool. The '329 device further incorporates a set screw mechanism to assist in the clamping function thereof, the set screw mechanism being pivotally mounted to the device and secured in place via a further pivotally attached securement mechanism. The primary function of the wedge in the '329 device is to maintain the position of the lower of two workpieces engaged to the lower portion of a clamping bar after the upper of the two workpieces is clamped into engagement to the upper portion of the clamping bars by the set screw mechanism.

The '835 patent discloses a clamp for gluing columns or pillars comprised of a plurality of staves. Each stave defines a trapezoidal configuration such that when they are pled in engagement in a side by side orientation, the staves collectively define a substantially circular disposition. A loop clamp is provided to circumvent the staves when disposed in a circular configuration, and a pair of wedges are provided for tightening the loop clamp around the column. The pair of wedges are oriented in an opposing manner and are inserted between the loop clamp and the column such that as the wedges are moved toward each other, slack is taken out of the loop clamp, and vise versa.

Anderson, in the '152 patent, discloses a door stop in which a plate is positioned at an angle with respect to a floor and at a location such that when a door is opened a selected distance, the bottom of the door engages the plate. The exact location on the plate at which the door becomes engaged is dependant upon the angle of disposition of the plate, and the height above the floor of the bottom edge of the door. As the door continues to open after engagement with the plate, the plate is pushed downward until the upper end of the plate engages the floor. To this extent, the upper end of the plate is curved under such that the plate may not be pushed completely to the floor, thus negating the benefit of the sloped orientation of the plate. In order to maintain the position of the plate, with the upper end above the floor, a spring device is provided. The spring device also serves to slow the movement of the door once engaged with the plate.

The '874 device disclosed by Lindberg includes a pair of oppositely disposed claws similar to the type described above, with an elongated member, a first clamp portion secured at one end, and a second clamp portion received along the length of the elongated member. A series of notches is defined by the elongated member for engaging the second clamp portion and provides a gross adjustment means. A pair of wedge members is provided in much the same manner as in the '835 device described above and is disposed between the second clamp portion and the top board that is being clamped. The wedge members are moved along each other in order to adjust the grip of the clamp.

Rockwell discloses a trapezoidal frame comprised of four hinged members that are capable of being folding out into a planar configuration. Two sets of boards to be glued to each other in a face-to-face orientation are placed on either side panel of the frame and the frame is then folded into its trapezoidal disposition The boards on either side are then disposed relative to the horizontal at an angle of less than 90°. A plurality of wedges having sides defining the same angular disposition of the boards is placed between the two sets of boards and forcibly wedged therebetween, thus creating pressure to enhance the bond of the boards.

In the '096 patent, Green et al. disclose a connecting clamp useful for constructing scaffolding. A wedge clamping member is providing for being inserted into openings defined by both an upright and a cross member. The wedge clamping member, however, is not forcibly engaged in either of the openings to provide a tightening effect, but is configured in the shape of a wedge in order to prevent the clamping member from falling through the openings.

The '098 device disclosed by Okura et al. is a cable clamp having a wedge-shaped shim. The shim is telescopically received wit a sleeve. However, Okura fails to teach a device for holding a plurality of planar workpieces in close relation to each other.

Wier ('646) discloses a clamp ember able to be releasably engaged upon a substantially circular shaft having a relatively smooth surface. A resilient wedge is disposed between the clamp and the shaft in order to prevent relative movement of the two.

Gendreau et al. ('432) disclose a clamp for attaching various devices to framing systems in order to maintain vertical alignment of concrete forms. Specifically, the '432 device is provided to secure a horizontal beam, or waler, to a vertical, or strongback, beam. The device includes a substantially U-shaped member configured to receive the strongback beam and the waler, with the distal ends configured to engage the far side of the waler. A wedge-shaped member is then inserted between the strongback beam and the cross member of the U-shaped member and is hammered into place, thus drawing the strongback member and the waler into close contact. However, Gendreau et al. do not teach a device capable of securing the relative position of a polity of boards disposed in a side-by-side disposition In the '426 patent, Hart teaches the use of a wedge to secure a post within a receptor. Again, Hart ails to teach the use of a wedge to maintain several planar members in a side-by-side disposition. Finally, of the prior art cited above, Brown et al. ('015) disclose a rod gripping device. The rod is received through an opening in a support member. A locking pin is received through an opening defined orthogonally to the rod opening. The rod opening and the locking pin opening are configured such that a portion of each overlaps, and further such that the rod, when received within the rod opening, is partially received within a central portion of the locking pin opening. The locking pin opening defines a diameter greater than the diameter of the locking pin such that the locking pin may be received within the locking pin opening without interfering with the rod. A wedge member is carried by either end of the locking pin such that the rod is disposed therebetween when in place. The wedge members are oriented in such a manner that when they are each moved toward the rod, each grips the rod and prevents movement thereof within the support. Thus, the '015 device is provided for preventing axial and linear movement of the rod within the support. However, it does not provide for the maintenance of a plurality of planar members in a side-by-side disposition.

Therefore, it is an object of this invention to provide a means for clamping a plurality of planar members, such as wooden boards, in a side by side disposition.

It is also an object of the present invention to provide such a means which is adjustable to accommodate workpieces of various thicknesses, widths and lengths, and to accommodate various numbers of such workpieces.

Further, it is an object of the present invention to provide such a means which nay be adapted to be used at either end or along the length of the workpieces, individually or in combination with other such means.

DISCLOSURE OF THE INVENTION

Other objects and advantages will be accomplished by the present invention which is provided for clamping a plurality of planar members, such as wooden boards, in a side-by-side disposition for work such as gluing to be performed on the boards. The wedge clamp of the present invention is adjustable to accommodate workpieces of various thicknesses, widths and lengths, and to accommodate a plurality of such workpieces. Moreover, the wedge clamp of the present invention may be adapted to be used at either end or along the length of the workpieces, individually or in combination with other such wedge clamps.

The wedge clamp includes a rail unit and at least one wedge block. In order to accommodate stock of various thicknesses, at least one spacer is provided. To accommodate disposition of the wedge clamp along the length of the stock, as opposed to at either end, a retainer block is provided. The wedge clamp is used in combination with another wedge clamp when disposed at either end of the stock material. For longer pieces of stock, or for stock of varying lengths, it may be more desirous to employ one or more wedge clamps along the length of the stock in order to prevent warping or bowing of the stock In this disposition, an end cap is provided for maintaining the relative positions of the stock members. The end cap is configured to closely receive the end of each stock member, thereby limiting relative movement of the stock members to a direction linearly toward and away from each other, such movement then being prevented by a force applied between the rail unit base member and the wedge block.

The rail unit includes a track defined by two opposing side walls and an end wall. The side walls and the end wall are disposed in a U-shaped configuration in order to closely receiving the stock members. The side walls are spaced apart to define a throat for closely receiving a selected thickness of stock. As successive pieces of stock, or workpieces, are received within the throat of the rail unit, they are each brought into alignment with each other workpiece. A base member is provided at one end of the rail unit. The first end of the base member is secured to each of the side walls and the end wall. The base member serves as an anchor for the workpieces being clawed together. A second end of the base member extends away from side walls a distance at least as great as the width of the throat, thereby accommodating at least the same stock capacity when used along the length of the stock. The extended portion of the base member further serves to balance the wedge clamp when the wedge clamp is disposed in a vertical orientation.

The side walls and the end wall define a series of slotted openings for receiving a wedge block. The slotted openings defined by each of the side walls defines a first length and are formed at corresponding elevations. The slotted openings defined by the end wall define a second length and are formed at elevations other than those of the side wall slotted openings The wedge block is dimensioned to be received in any one of the slotted openings defined by either of the side walls or the end wall The width of the wedge block is dimensioned to be closely received between the sides of the slotted openings. The top surface of the wedge block is contoured to closely be received within the contour of the upper limit of the slotted openings.

When the wedge clamp is used to clamp the ends of the workpieces which define a thickness less than the rail unit throat, at least one spacer is used to reduce the width of the throat and ensure close receipt of the stock material therein. The spacer defines an L-shaped cross section, with the first leg defining a first thickness and the second leg defining a second thickness. The respective first and second legs are alternately useful for defining alternate throat widths.

A retainer block is provided for assisting in using the rail unit to clamp workpieces along the length thereof. The retainer block is dimensioned to be closely received within the track of the rail unit in a lengthwise direction. A first notch is defined at a first end thereof for closely receiving stock material defining a first thickness, while a second notch is defined at a second end thereof for closely receiving stock material of a second thickness. In this disposition, the stock material is disposed such that one side thereof is placed in engagement with the outer edge of the side walls. The lowermost edge of the stock material is placed in engagement with the base member. The retainer block is then received over the uppermost edge of the stock material and within the track define by the rail unit. A wedge block is then introduced into an appropriate slotted opening in either of the side walls or the end wall.

BRIEF DESCRIPTION OF THE DRAWINGS

The above mentioned features of the invention will become more clearly understood from the following detailed description of the invention read together with the drawings in which.

BEST MODE FOR CARVING OUT THE INVENTION

A wedge clamp incorporating various features of the present invention is illustrated generally at 10 in the figures. The wedge clamp 10 is designed for clawing a plurality of stock members 70, such as wooden boards, in a side-by-side disposition for work to be performed thereon, such as for gluing. The wedge clamp 10 of the present invention is adjustable to accommodate workpieces of various thicknesses, widths and lengths, and to accommodate various numbers of such stock members 70. Moreover, the wedge clamp 10 of the present invention may be adapted to be used at either end or along the length of the stock members 70, individually or in combination with other such wedge clamps 10.

Figure 1:
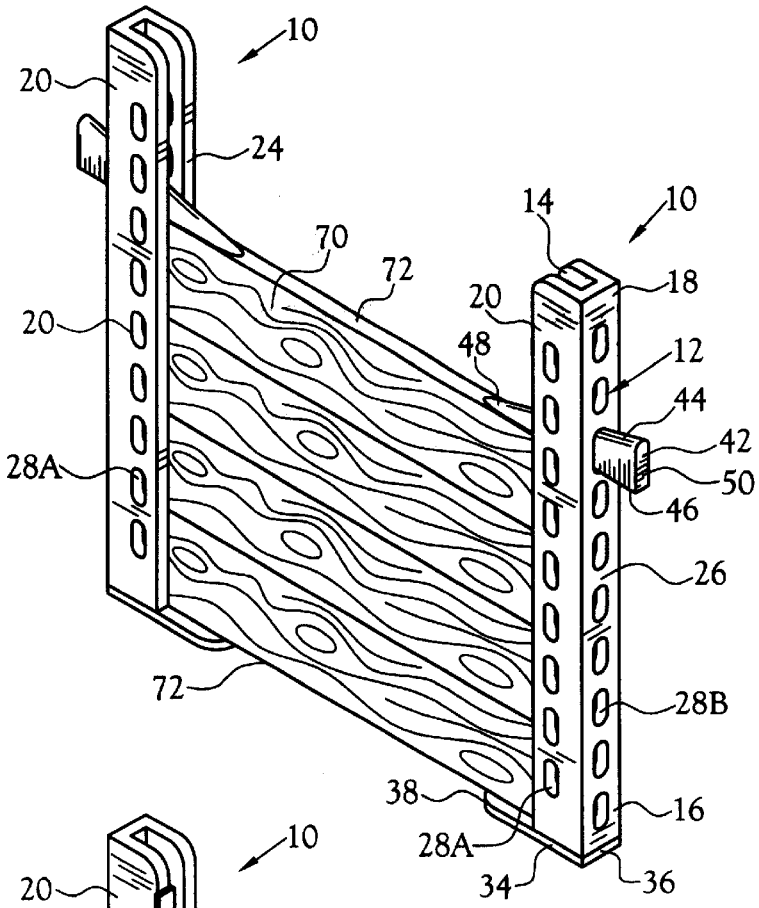
FIG. 1 is a perspective view of two wedge clamps constructed in accordance with several features of the present invention being used in a first disposition.
Figure 4:
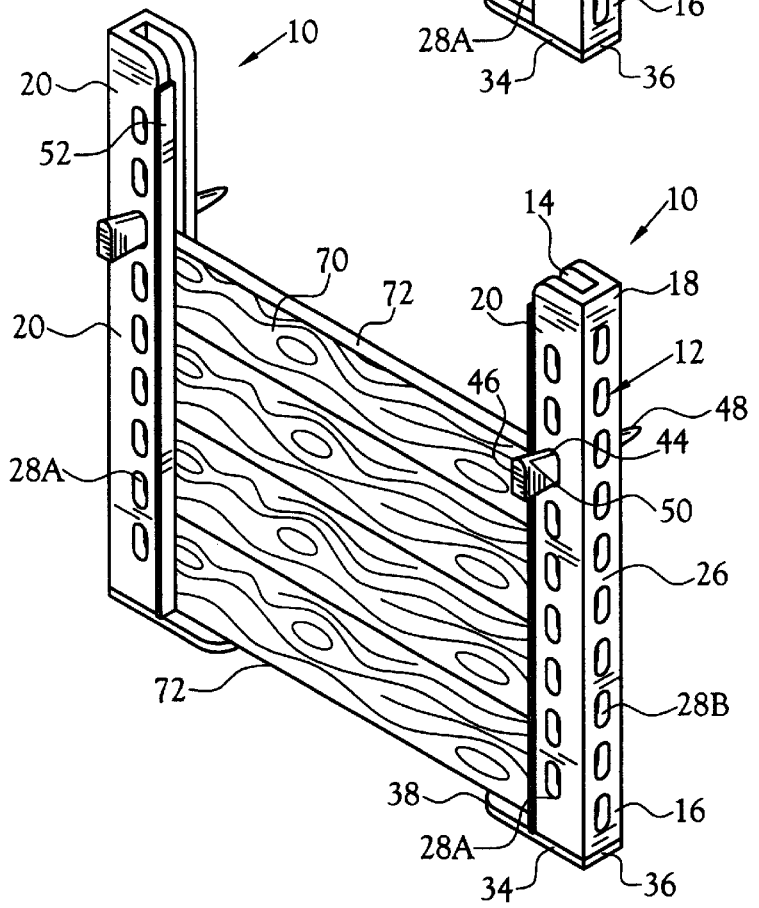
FIG. 4 is a perspective view of two wedge clamps constructed in accordance with several features of the present invention being used in a second disposition.
Figure 9:
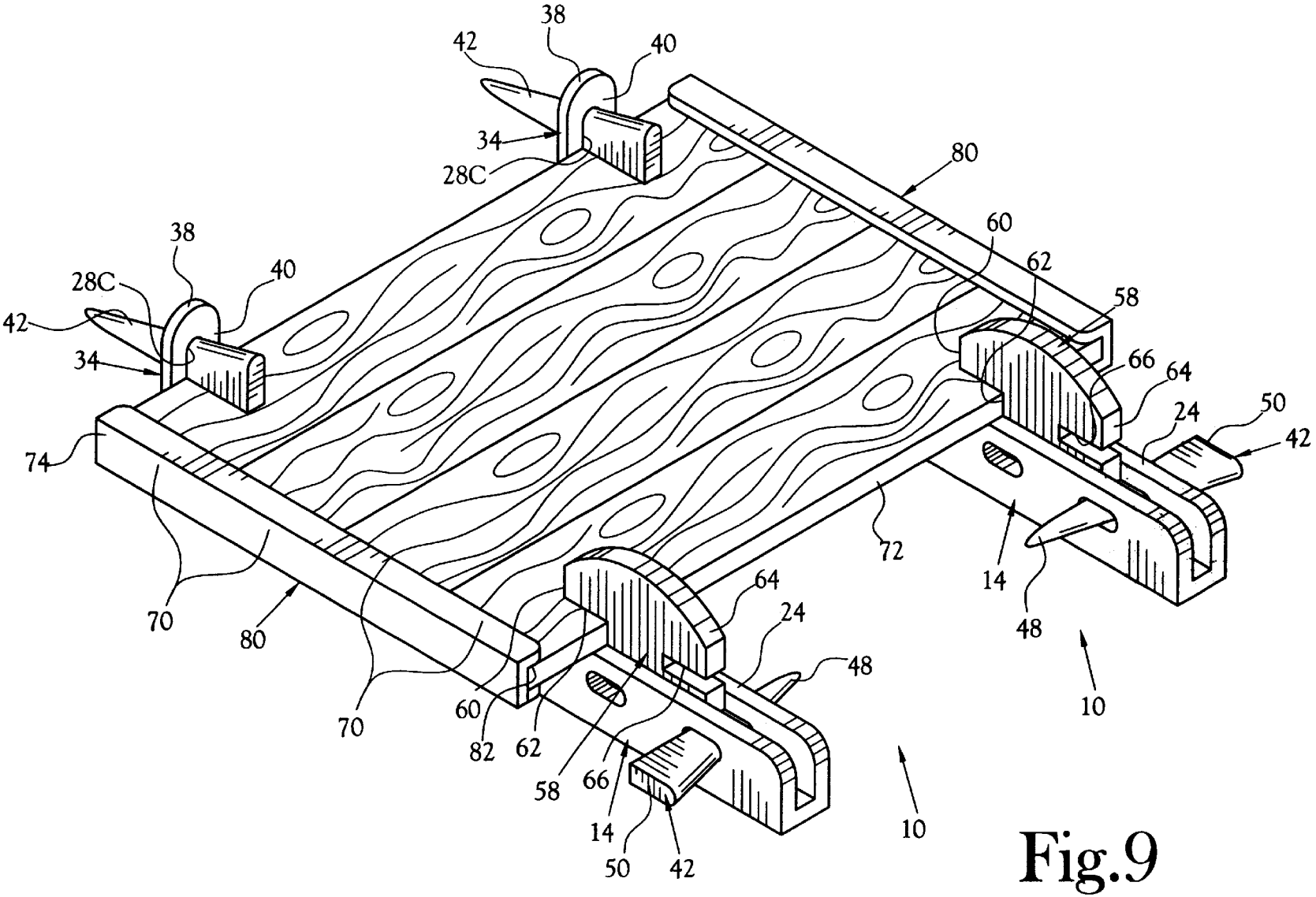
FIG. 9 is a perspective view of two wedge clamps constructed in accordance with several features of the present invention being used in a fourth disposition.
Figure 10:
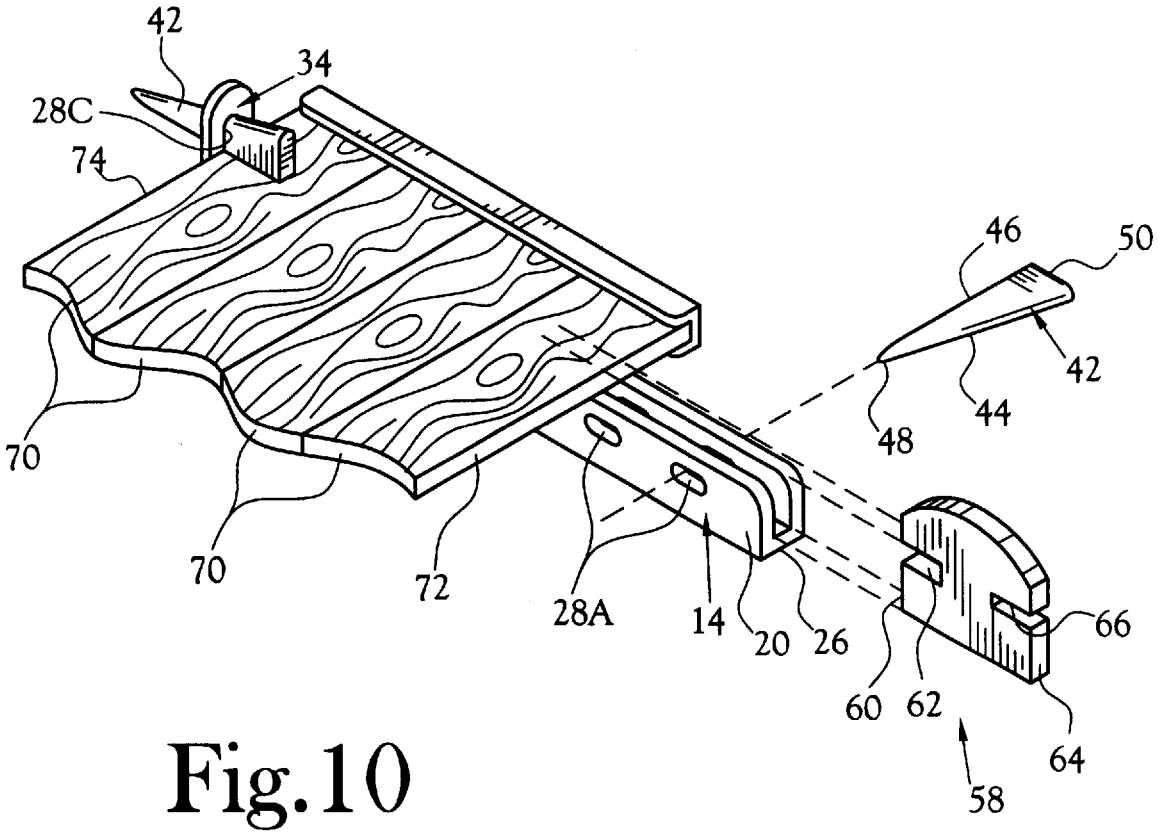
FIG. 10 is an exploded perspective view of a wedge clamp illustrated in FIG. 9.

As illustrated in FIG. 1, the wedge clamp 10 of the present invention is comprised primarily of a rail unit 12 and at least one wedge block 42. In order to accommodate stock 70 of various thicknesses, at least one spacer 52 is provided (see FIG. 4). Further, as illustrated in FIG. 9, to accommodate disposition of the wedge clamp 10 along the length of the stock 70, as opposed to at either end, a retainer block 58 is provided. The wedge clamp 10 of the present invention is used in combination with another wedge clamp 10 when disposed at either end of the stock material. For longer pieces of stock 70, or for stock 70 of varying lengths, it may be more desirous to employ one or more wedge clamps 10 along the length of the stock 70 in order to prevent warping or bowing thereof.

Figure 2:
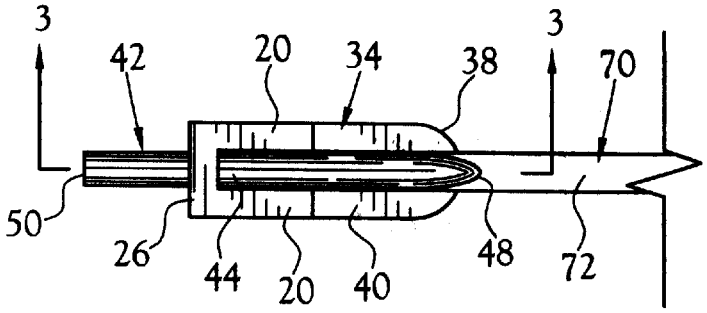
FIG. 2 illustrates a top plan view a wedge clamp illustrated in FIG. 1.

As best illustrated in FIG. 2, the rail unit 12 includes a track 14 defined by two opposing side walls 20 and an end wall 26. The side walls 20 and the end wall 26 are disposed in a U-shaped configuration in order to closely receiving the stock members 70. To this extent, the side walls 20 are spaced apart to define a throat 22 for closely receiving a selected thickness of stock 70. For example, the side walls 20 may be spaced at one inch (1") for accommodating stock 70 of like thickness. Thus, as successive pieces of stock 70 are received within the throat 22 of the rail unit 12, they are each brought into alignment with each other stock member 70. Although the present invention is not limited to these dimensions, common dimensions for a rail unit throat 22 are 1" and ¾".

Figure 3:
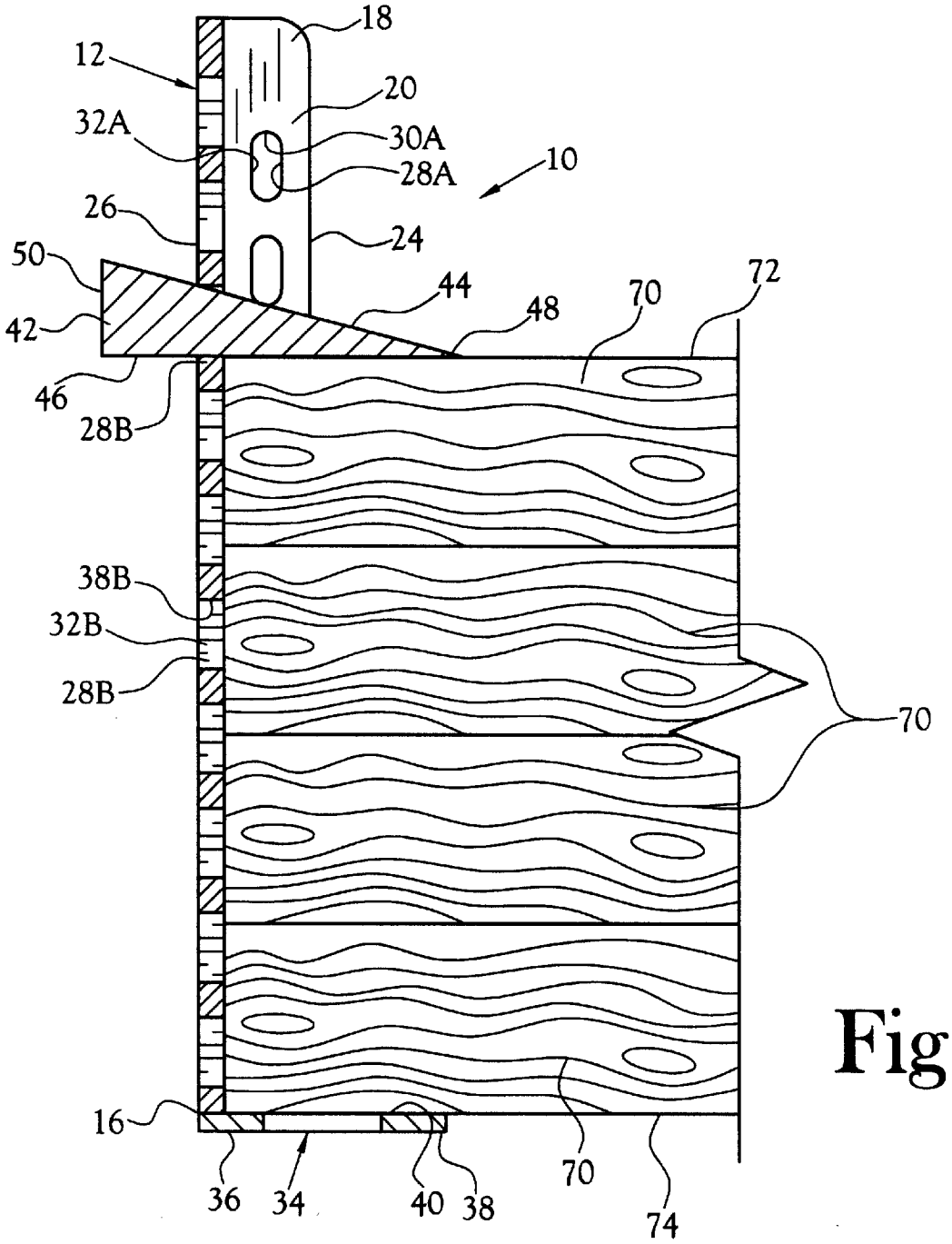
FIG. 3 is a front elevation view of the wedge clamp, shown partially in section as taken along 3—3 of FIG. 2.
Figure 5:
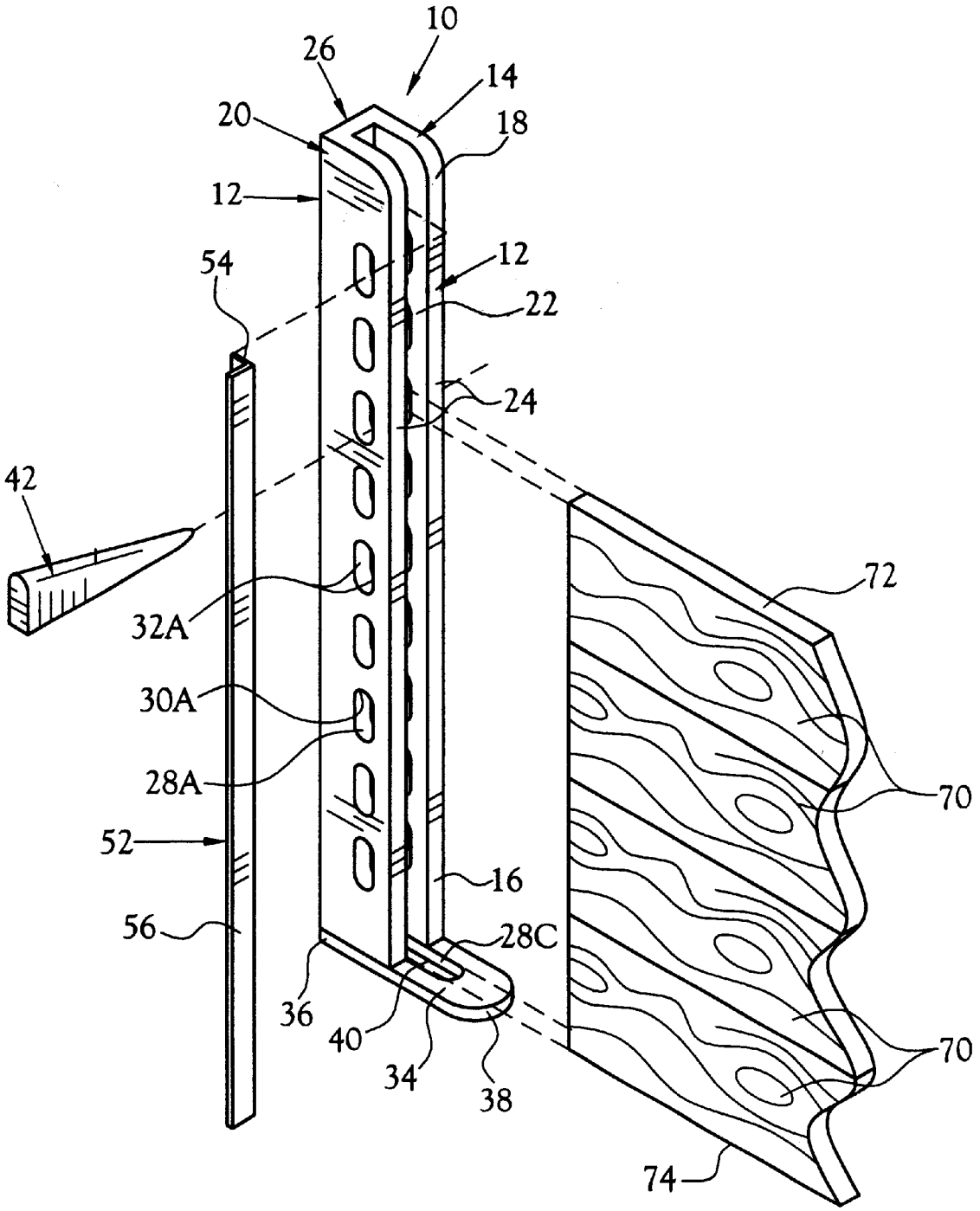
FIG. 5 is an exploded perspective view of a wedge clamp illustrated in FIG. 4.

A base member 34 is provided at one end 18 of the rail unit 12. As best illustrated in FIG. 3, the first end 36 of the base member 34 is secured to each of the side walls 20 and the end wall 26. The base member 34 serves as an anchor for the stock members 70 being clawed together. To this extent, a second end 38 of the base member 34 extends away from side walls 20. In the preferred embodiment, the second end 38 extends away from the side walls 20 a distance at least as great as the width of the throat 22, thereby accommodating at least the same stock capacity when used along the length of the stock 70 (as illustrated in FIGS. 9–12) as when disposed at the end thereof (as illustrated in FIGS. 1–8). The extended portion 38 of the base member 34 further serves to balance the wedge clamp 10 when the wedge clamp 10 is disposed in a vertical orientation as illustrated in FIG. 1.

In the illustrated embodiment, the various components of the rail unit 12 are secured together in a conventional manner such as by gluing or nailing. In this particular embodiment, the rail unit 12 is fabricated from wood. However, it will be understood that the rail unit 12 may be fabricated from other rigid materials and may be formed in various conventional methods such as by conventional plastic and/or metal molding techniques.

At least one of the side walls 20 and the end wall 26 defines a series of openings 28 for receiving a wedge block 42. In order to increase the variety of dimensions of the overall stock width, the openings 28 of the preferred embodiment are slotted. Also in the preferred embodiment, as illustrated, each of the side walls 20 and the end wall 26 define a series of slotted openings 28, thus allowing for the use of the wedge clamp 10 in various orientations with respect to the stock 70, depending upon the particular use of the wedge clamp 10. In the preferred embodiment, each of the side walls 20 defines a series of equally-spaced slotted openings 28A, each defining an equal length. The slotted openings 28B defined by the end wall 26 are likewise equally spaced and define an equal length. Further, the slotted openings 28B of the end wall 26 are disposed such that they overlap the slotted openings 28A of the side walls 20, thereby providing for the clamping of any combined width of stock members. However, it will be understood that the present invention is not limited to this configuration, and is intended to cover all variations with respect to at least the length and disposition of the slotted openings 28A,B.

The wedge block 42 is dimensioned to be received in any one of the slotted openings 28 defined by either of the side walls 20 or the end wall 26. The width of the wedge block 42 is dimensioned to be closely received between the sides 32 of the slotted opening 2& The upper surface 44 of the wedge block 42 is contoured to closely be received within the contour of the upper limit 30 of the slotted openings 28. In the illustrated embodiment, the upper limit 30 of the slotted openings 28, and therefore the upper surface 44 of the wedge block 42, is arcuate. By configuring the wedge block 42 to be closely received by the sides 32 and upper limit 30 of the slotted openings 28, the contact area of engagement between the slotted opening 28 and the wedge block 42 is maximized, thus minimizing the risk of the wedge block 42 from slipping out of the slotted opening 28 and also reducing the tendency of the wedge block 42 to twist within the slotted opening 28.

As illustrated in FIGS. 4–8, when the wedge clamp 10 is used to claw the ends of the stock members 70, at least one spacer 52 is provided for varying the width of the throat 22 in order to accommodate stock 70 of thicknesses less than the width of the throat 22. One or more spacers 52 are inserted between the stock members 70 and a side wall 20 in order to decrease the throat 22 of the track 14 and ensure close receipt of the stock members 70 therein. This is more clearly illustrated in FIG. 5, which is an exploded isometric view of the wedge clamp 10. In this illustration, a spacer 52 is placed on one side of the track 14, and the stock 70 is received between the spacer 52 and one side wall 20 of the wedge clamp 10. A wedge block 42 is received through a pair of corresponding slotted openings 28A in the side walls 20.

Figure 6:
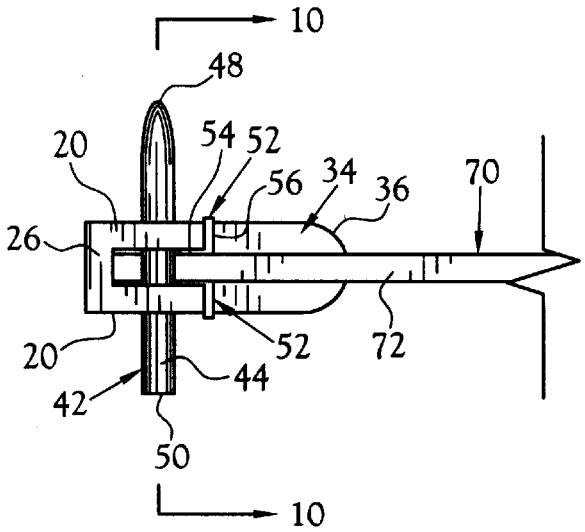
FIG. 6 illustrates a top plan view a wedge clamp illustrated in FIG. 4.

As most clearly illustrated in FIG. 6, the spacer 52 of the preferred embodiment defines an L-shaped cross section, with the first leg 54 defining a first thickness and the second leg 56 defining a second thickness. By defining first and second thicknesses, the respective first and second legs 54,56 are alternately useful for defining alternate throat widths within the track 14. More than one spacer 52 may be employed, with one being disposed on either side of the rail member 12, in order to define further alternate throat widths as well. For example, a first spacer 52 defining first and second leg thicknesses of ¼" and ½", respectively, used individually or in combination with a second spacer 52 defining first and second leg thicknesses of ⅜" and ⅝", respectively, is capable of reducing the track width by ¼", ⅜", ½", ⅝", ⅞", 1" or 1⅛". It win be understood that various other combinations are useful in various applications.

Figure 7:
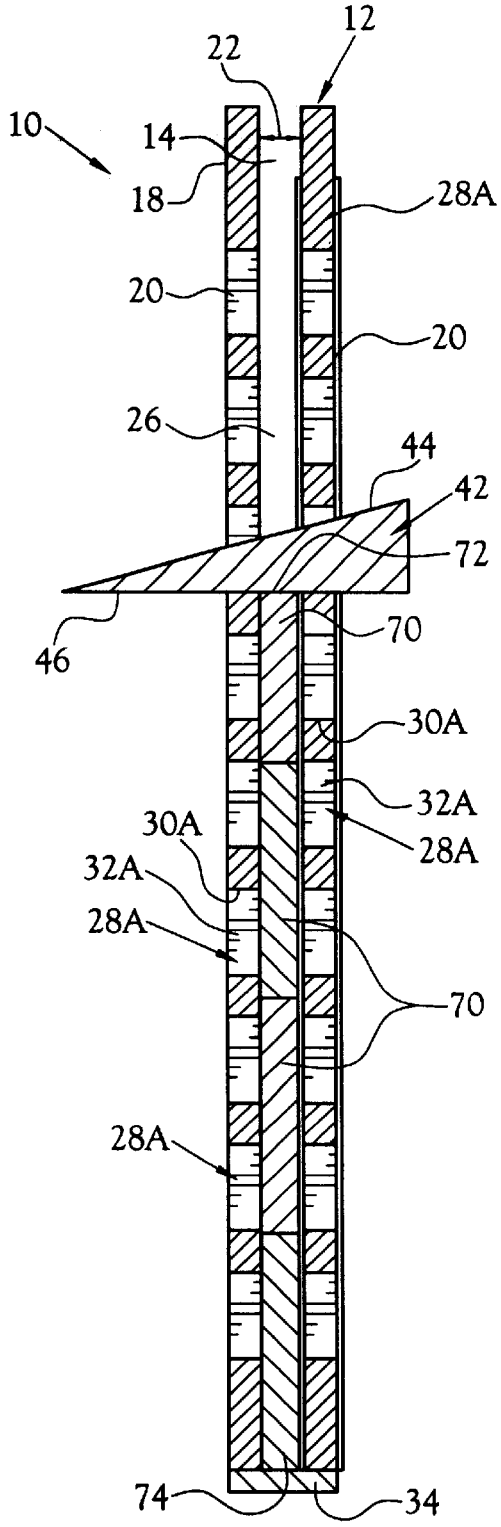
FIG. 7 is a front elevation view of the wedge clamp, shown partially in section as taken along 7—7 of FIG. 6.

FIG. 7 is provided for illustrating the engagement between the wedge block 42 and the stock material 70, and between the wedge block 42 and the side wall slotted openings 28A. The bottom surface 46 of the wedge block 42 is engaged with the top surface 72 of the uppermost stock member 70 and is driven into the slotted openings 28A of the side walls 20. As the wedge block 42 is so driven, the distal end 48 is received through a corresponding slotted opening 28A in the opposing side wall 20. The wedge block 42 is driven into the side wall slotted opening 28A until the upper surface 44thereof is in close engagement with the upper knit 30 of the slotted opening 28A, thereby preventing unintentional removal thereof As the wedge block 42 is driven into the slotted opening 28A, a force is created between the wedge block 42 and the stock material 70, causing the individual stock members 70 to be more tightly pressed together. The lowermost edge 74 of the stock material 70 is engaged and retained by the base member 34.

Figure 8:
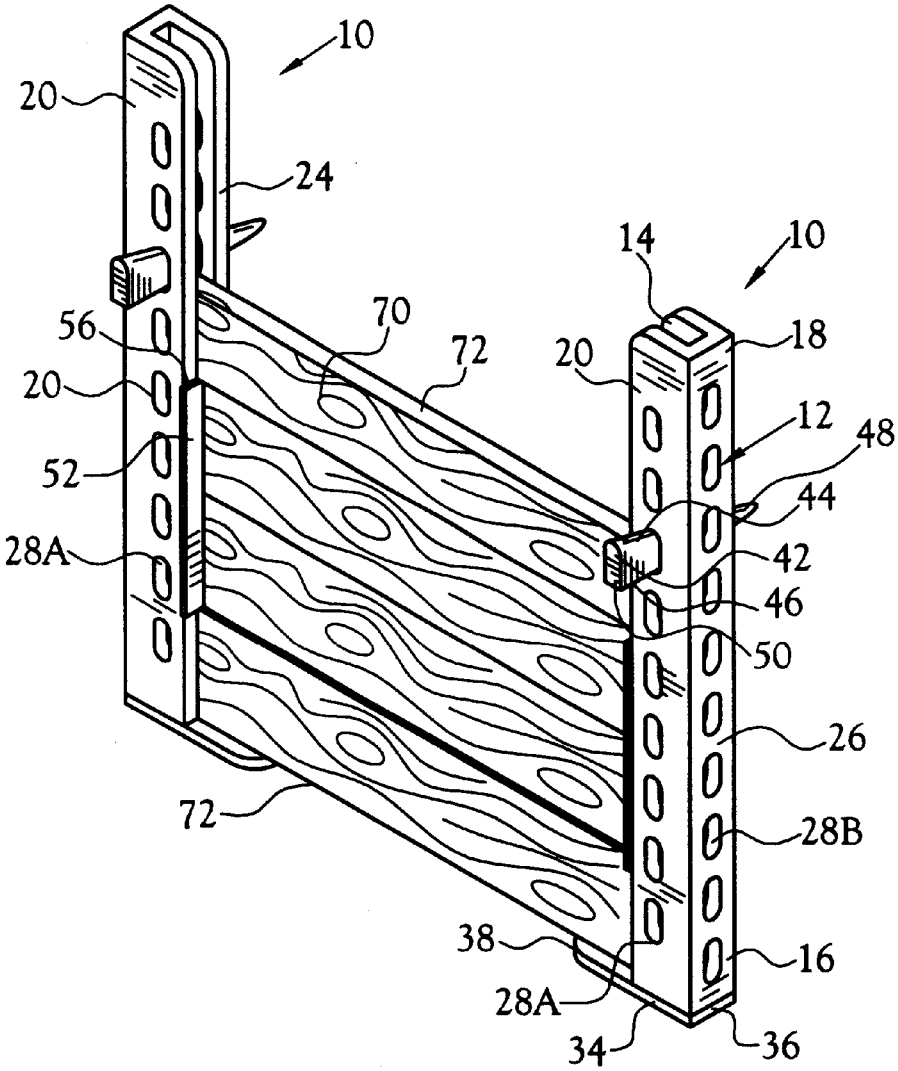
FIG. 8 is a perspective view of two wedge clamps constructed in accordance with several features of the present invention being used in a third position.

The length of the spacers 52 illustrated in the previously described figures are approximately equal to the length of the rail unit 12 in order to accommodate a plurality of stock members 70, each defining the same thickness. However, as illustrated in FIG. 8, the length of the spacer 52 may be equal to or less than the width of a single piece of stock 70. By so dimensioning the spacer 52, stock members 70 of varying thicknesses may be closely and simultaneously received with the track 14 of the rail unit 12.

The wedge clamp 10 illustrated in FIG. 9 further includes a retainer block 58 for assisting in using the rail unit 12 to clamp stock members 70 along the length thereof. Particularly, this disposition of the wedge clamp 10 is useful for clamping relatively short stock members, where a single wedge clamp 10 disposed proximate the central portion thereof is sufficient, or for clamping relatively long stock members where one or more wedge clamps 10 are useful. In this disposition, the stock material 70 is disposed such that one side thereof is placed in engagement with the outer edge 24 of the side walls 20. As in the previous embodiment, the lowermost edge 74 of the stock material 70 is placed in engagement with the upper surface 40 of the base member 34. The retainer block 58 is then received over the uppermost edge 72 of the stock material 70 and within the track 14 define by the rail unit 12. A wedge block 42 is then introduced into an appropriate slotted opening 28 in either of the side walls 20 or the end wall 26. This arrangement is more clearly illustrated in FIG. 10, which is an exploded view of the components Rated in FIG. 9.

Also utilized in the illustration of FIG. 9 is a slotted opening 28C disposed in the base member 34. After the stock material 70 has been properly positioned on the rail unit 12, a wedge block 42 is inserted wedged into tight engagement with the slotted opening 28C. Thus, the bottom edge of the stock material 70 is prevented from "kicking out" as a result of the forces applied through the engagement of the retainer block 58 as described above.

In order to prevent the individual pieces of stock material 70 from rotating out of the wedge clamp 10 when held in the disposition illustrated in FIG. 9, an end cap 80 is provided. The end cap 80 is configured to define a throat 82 to closely receive the end of each piece of stock material 70. Although not shown, as with the wedge claw rail unit 12, one or more spacers 52 may be used to vary the dimension of the throat 82 in order to accommodate stock material 70 of various thicknesses.

Figure 11:
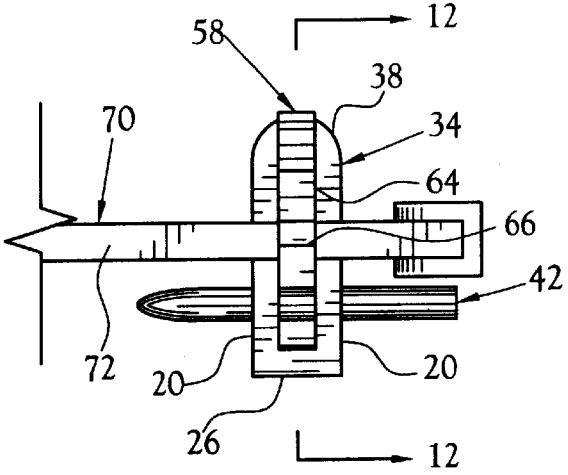
FIG. 11 illustrates a top plan view of a wedge clamp illustrated in FIG. 9.
Figure 12:
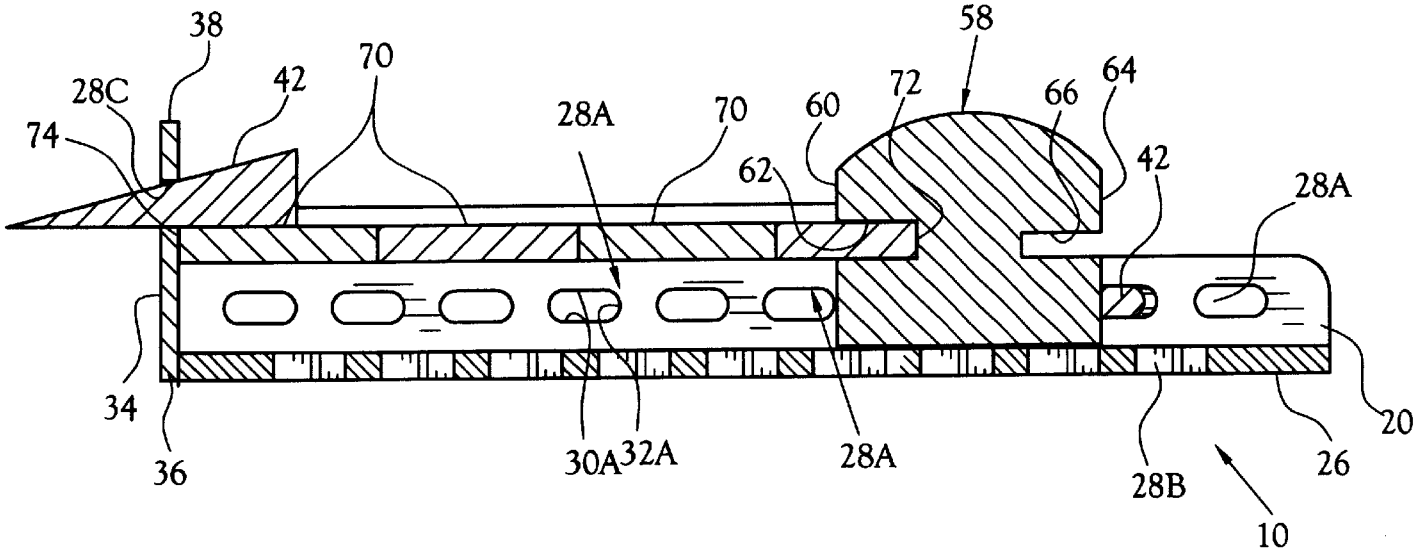
FIG. 12 is a front elevation view of the wedge clamp, shown partial in section as taken along 12—12 of FIG. 11.

FIGS. 11 and 12 more clearly illustrate the relative engagements of the various components in this embodiment. As illustrated in FIG. 12, the retainer block 58 is dimensioned to be closely received within the track 14 of the rail unit 12 in a lengthwise direction. A first notch 62 is defined at a first end 60 thereof for closely receiving stock material 70 defining a first thickness, while a second notch 66 is defined at a second end 64 thereof for closely receiving stock material 70 of a second thickness. Thus, the retainer block 58 is useful for alternately retaining stock material 70 defining two different thicknesses.

Figure 13:
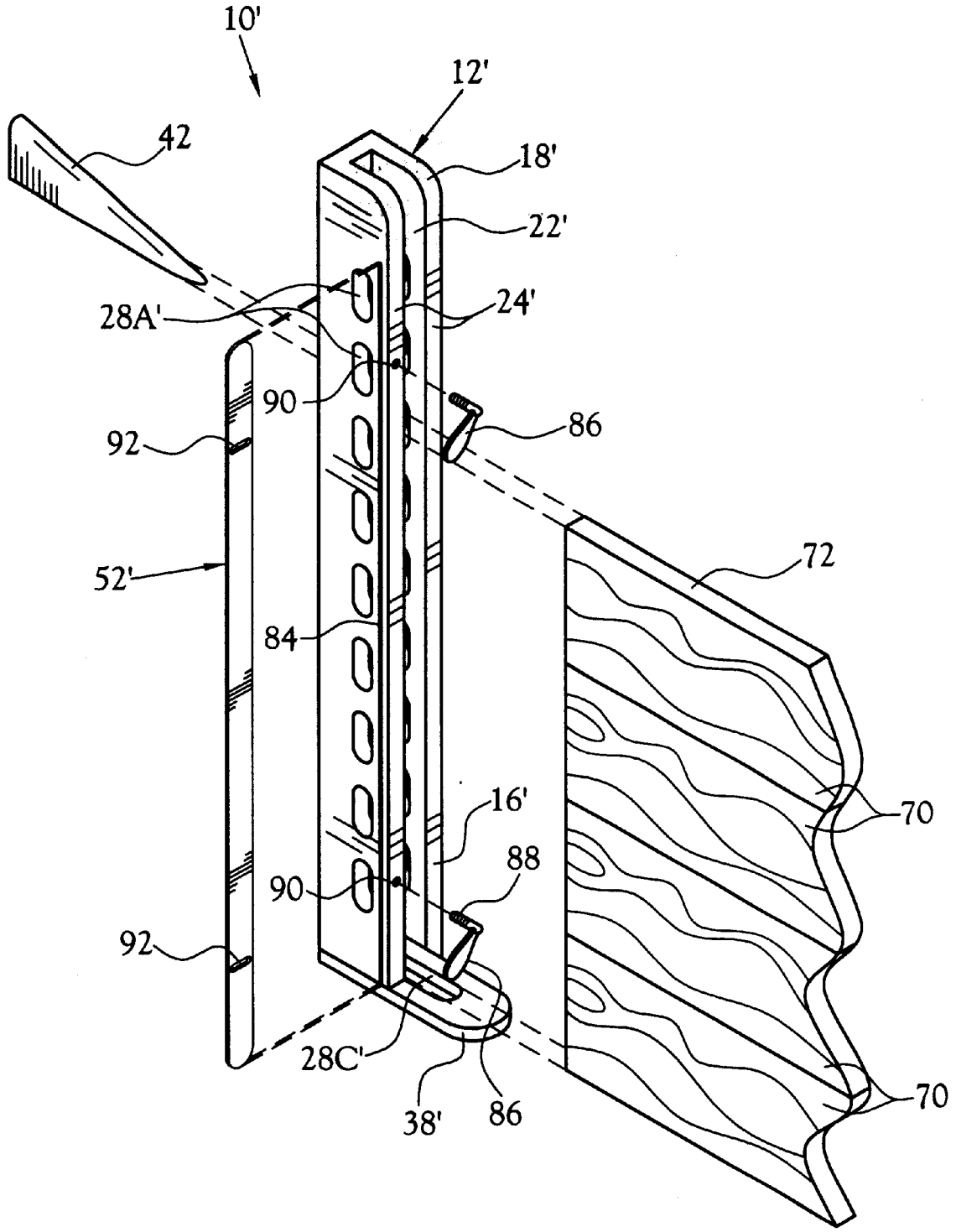
FIG. 13 is an exploded perspective view of an alternate embodiment of the wedge clamp constructed in accordance with several features of the present invention.
Figure 14:
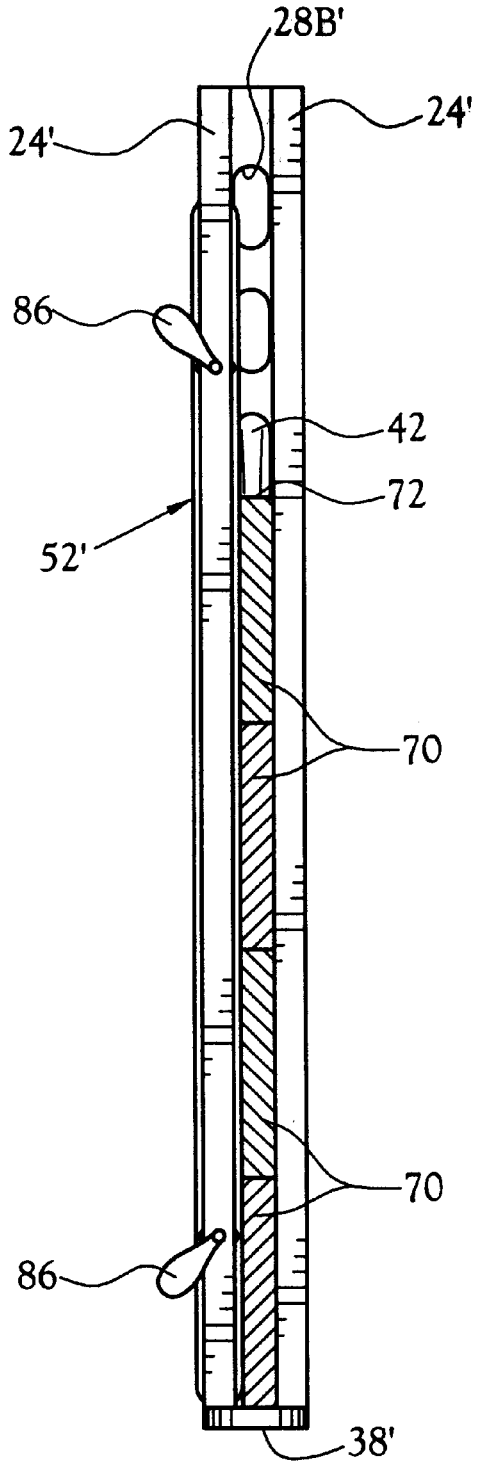
FIG. 14 is an elevation view of the wedge clamp of FIG. 13.

Illustrated in FIGS. 13 and 14 is an alternate embodiment of the wedge clamp 10'. The rail unit 12' defines a slotted opening 84 substantially along the length thereof on one side wall 20'. A spacer 52' is slidably received within the slotted opening 84 in order to reduce the effective throat width of the rail unit 12'. At least one locking mechanism 86 is provided for locking the spacer 52' when stock material 70 having a thickness less than the rail unit 12' throat is received in the rail unit 12', as best illustrated in FIG. 14. In the illustrated embodiment, the locking mechanism 86 includes a threaded post 88 for cooperating with a threaded opening 90 defined by the side wall 20'. A slotted opening 92 is defined by the spacer 52', the slotted opening 92 being dimensioned to receive the end of the threaded post 88 and oriented to allow the spacer 52' to move laterally into and out of the rail unit 12' throat when the locking mechanism 86 is loosened.

The length of the slotted openings 92 defines the travel length of the spacer 52'. Accordingly, in the preferred embodiment, the slotted openings 92 are dimensioned to allow the spacer 52' to be completely withdrawn from within the rail unit throat 22' and to allow the spacer 52' to be inserted into the throat 22' of the rail unit 12' until it reaches the opposing side wall 20'. Thus, it will be seen that the spacer 52' allows the throat 22' of the rail unit 12' to be effectively varied to any thickness of stock material 70 no greater than the rail unit throat 22'.

Although not illustrated in the figures, there may be situations in which there is not an easily usable slotted opening 28 for clamping the stock material 70 desired. In such situations, a slotted opening 28 disposed further away from the uppermost edge 72 of the stock material 70 is preferred, even though the entirety of the slotted opening 28 is above the stock material uppermost edge 72. In such situations, it has been found useful to insert one end of a further wedge block 42 between the stock material 70 or retainer block 58 and the first wedge block 42 received in the side wall or end wall slotted opening(s) 28A,B. To this extent, the further wedge block 42 being used as a spacer is preferably turned on its side to provide parallel surfaces to be engaged by the stock material 70 or retainer block 58 and the first wedge block 42.

From the foregoing description, it will be recognized by those skilled in the art that a wedge clamp offering advantages over the prior art has been provided. Specifically, the wedge clamp provides a means for clamping a plurality of stock members in a side-by-side orientation for performing work, such as gluing, on the same. As described and illustrated, the wedge clamp is adjustable to accommodate workpieces of various thicknesses, widths and lengths, and to accommodate various numbers of such workpieces. Moreover, the wedge clamp is adaptable for use at either end or along the length of the workpieces, individually or in combination with other such wedge clamps.

While a preferred embodiment has been shown and described, it will be understood that it is not intended to limit the disclosure, but rather it is intended to cover all modifications and alternate methods falling within the spirit and the scope of the invention as defined in the appended clams.

Having thus described the aforementioned invention, I claim:

1. A wedge clamp for clamping a plurality of planar members in a side-by-side disposition for work to be performed thereon, said wedge clamp comprising:

a raid unit including a track defined by opposing first and second side walls and an end wall, said first and second side walls and said end wall disposed in a U-shaped configuration for closely receiving at least one stock member defining a fist thickness, said first and second side walls being spaced apart to define a throat having a first width for closely receiving the at least one stock member, said track defining a length to receive the at least one stock member in a side-by-side disposition, at least one of said first and second side walls and said end wall defining a series of openings;

a base member secured at a fist end to a lower end of said track, a second end of said base member extending away from said track, said base member defining an opening proximate said second end thereof; and at least one wedge block dimensioned to be closely received by an upper limit of one of said series of openings and to engage an upper edge of the at least one stock member, a top surface of said wedge block being contoured to closely be received within a contour of said upper limit of said one of said series of openings, said wedge block defining a taper from a first end to a second end thereof, the at least one stock member being champed between a lower surface of said wedge block and an upper surface of said base member.

2. The wedge clamp of claim 1 wherein said base member second end extends away from said track a distance at least as great as a width of said throat.

3. The wedge clamp of claim 1 wherein each of said series of rail unit openings and said base member opening is slotted.

4. The wedge clamp of claim 1 wherein each of said first and second side walls defines a first of said series of openings and wherein said end wall defines a second of said series of openings, each of said first series of openings defining a first length and being formed at a first series of elevations above said track lower end, each of said second series of openings defining a second length and being formed at a second series of elevations above said track lower end.

5. The wedge clamp of claim 1 further comprising at least one spacer configured to be received within said track to reduce said track width to closely receive at least one stock member defining a second thickness smaller than said first thickness.

6. The wedge clamp of claim 5 wherein said at least one spacer defines an L-shaped cross section having a first leg defining a first spacer thickness and a second leg defining a second spacer thickness.

7. The wedge clang of claim 5 wherein said at least one spacer defines a length substantially equal to said track length.

8. The wedge clamp of claim 5 wherein said at least one spacer defines a length less than said track length such that said track closely receives the at least one stock mender defining said first thickness and at least one stock member defining said second thickness.

9. The wedge clamp of claim 5 wherein said at least one spacer is configured to be slidably received within a slotted opening defined by one of said first and second rail unit side walls, said wedge clamp further comprising a locking mechanism for locking said at least one spacer to define a second width between a leading edge of said spacer and the other of said first and second rail unit side walls, said second width being less than said first width defined by said rail unit throat.

10. The wedge clamp of claim 1 further comprising at least one retainer block, said retainer block being configured to be closely received within said track, a first notch being defined at a first end of said retainer block for closely receiving the stock material defining said first thickness.

11. The wedge clamp of claim 10 wherein said retainer block further defines a second notch at a second end thereof for closely receiving the stock material defining said second thickness.

12. The wedge clamp of claim 10 further comprising at least one end cap configured to closely receive an end of the stock material.

13. A wedge clamp for clamping a plurality of planar members in a side-by-side disposition for work to be performed thereon, said wedge champ comprising:

a rail unit including a track defined by opposing first and second side walls and an end wall, said first and second side walls and said end wall disposed in a U-shaped configuration for closely receiving at least one stock member defining a first thickness, said first and second side walls being spaced apart to define a throat having a first width for closely receiving the at least one stock member, aid track defining a length to receive the at least one stock member in a side-by-side disposition, each of said first and second side walls defining a first series of slotted openings, said end wall defining a second series of slotted openings, each of said first series of openings defining a first length and being formed at a first series of elevations above said track lower end, each of said second series of openings defining a second length and being formed at a second series of elevations above said track lower end;

a base member secured at a first end to a lower end of said track, a second end of said base member extending away from said track a distance at least as great as a width of said throat, said base member defining a slotted opening proximate said second end thereof; and at least one wedge block dimensioned to be closely received by an upper limit of one of said series of openings and to engage an upper edge of the at least one stock member, a top surface of said wedge block being contoured to closely be received within a contour of said upper limit of said one of said series of openings, said wedge block defining a taper from a first end to a second end thereof, the at least one stock member being clamped between a lower surface of said wedge block and an upper surface of said base member.

14. The wedge clamp of claim 13 father comprising at least one spacer configured to be received within said track to reduce said track width to closely receive at least one stock member defining a second thickness smaller than said first thickness.

15. The wedge clamp of claim 14 wherein said at least one spacer defines an L-shaped cross section having a first leg defining a first spacer thickness and a second leg defining a second spacer thickness.

16. The wedge clamp of claim 14 wherein said at least one spacer is configured to be slidably received within a slotted opening defined by one of said first and second rail unit side walls, said wedge clamp further comprising a locking mechanism for locking said at least one spacer to define a second width between a leading edge of said spacer and the other of said first and second rail unit side walls, said second width being less than said first width defined by said rail unit throat.

17. The wedge clamp of claim 13 further comprising at least one retainer block, said retainer block being configured to be closely received within said track, a first notch being defined at a firs end of said retainer block for closely receiving the stock material defining said first thickness.

18. The wedge clamp of claim 17 wherein said retainer block further defines a second notch at a second end thereof for closely receiving the stock material defining said second thickness.

19. A wedge clamp for clamping a plurality of planar members in a side-by-side disposition for work to be performed thereon, said wedge clamp comprising:

a rail unit including a track defined by opposing first and second side walls and an end wall, said first and second side walls and said end wall disposed in a U-shaped configuration for closely receiving at least one stock member defining a first thickness, said first and second side walls being spaced apart to define a throat having a first width for closely receiving the at least one stock member, said track defining a length to receive the at least one stock member in a side-by-side disposition, each of said first and second side walls defining a first series of slotted openings, said end wall defining a second series of slotted openings, each of said first series of openings defining a first length and being formed at a first series of elevations above said track lower end, each of said second series of openings defining a second length and being formed at a second series of elevations above said track lower end;

a base member secured at a first end to a lower end of said track, a second end of said base member extending away from said track a distance at least as great as a width of said throat;

at least one wedge block dimensioned to be closely received by an upper limit of one of said series of openings and to engage an upper edge of the at least one stock member, a top surface of said wedge block being contoured to closely be received within a contour of said upper limit of said one of said series of openings, said wedge block defining a taper from a first end to a second end thereof, the at least one stock member being clamped between a lower surface of said wedge block and an upper surface of said base member;

at least one spacer configured to be received within said track to reduce said track width to closely receive at least one stock member defining a second thickness smaller than said first thickness; and at least one retainer block, said retainer block being configured to be closely received within said track, a first notch being defined at a first end of said retainer block for closely receiving the stock material defining said first thickness and a second notch being defined at a second end thereof for closely receiving the stock material defining said second thickness.

20. The wedge clamp of claim 19 wherein said at least one spacer defines an L-shaped cross section having a fist leg defining a first spacer thickness and a second leg defining a second spacer thickness.

21. The wedge clamp of claim 19 wherein said at least one spacer is configured to be slidably received within a slotted opening defined by one of said first and second rail unit side walls, said wedge clamp further comprising a locking mechanism for locking said at least one spacer to define a second width between a leading edge of said spacer and the other of said first and second rail unit side walls, said second width being less than said first width defined by said rail unit throat.

* * * * *